US007747026B2

(12) United States Patent
Ball

(10) Patent No.: US 7,747,026 B2
(45) Date of Patent: Jun. 29, 2010

(54) SOUNDBRIDGE TEST SYSTEM

(75) Inventor: Geoffrey Ball, Sunnyvale, CA (US)

(73) Assignee: Vibrant Med-El, Innsbruck (AT)

( * ) Notice: Subject to any disclaimer, the term of this patent is extended or adjusted under 35 U.S.C. 154(b) by 0 days.

(21) Appl. No.: 11/640,472

(22) Filed: Dec. 14, 2006

(65) Prior Publication Data

US 2008/0031465 A1 Feb. 7, 2008

Related U.S. Application Data

(63) Continuation of application No. 10/181,647, filed as application No. PCT/US01/01957 on Jan. 19, 2001, now abandoned.

(60) Provisional application No. 60/177,406, filed on Jan. 20, 2000.

(51) Int. Cl.
*H04R 29/00* (2006.01)

(52) U.S. Cl. ..... 381/60; 607/57; 73/585

(58) Field of Classification Search ..... 381/60, 381/312, 328, 58, 322, 326; 607/57, 56; 73/585; 600/559, 552, 379, 25; 181/127, 181/128, 126
See application file for complete search history.

(56) References Cited

U.S. PATENT DOCUMENTS 3,985,960 A 10/1976 Wallace, Jr.
4,677,679 A 6/1987 Killion
5,061,186 A 10/1991 Jost et al. ..... 434/185
5,085,628 A * 2/1992 Engebretson et al. ..... 600/25
5,402,494 A 3/1995 Flippe et al.
5,554,096 A 9/1996 Ball
5,624,376 A 4/1997 Ball et al. ..... 600/25
5,703,797 A 12/1997 Russell
5,761,319 A 6/1998 Dar et al.
5,776,179 A 7/1998 Ren
5,800,336 A 9/1998 Ball
5,888,187 A 3/1999 Jaeger et al.

OTHER PUBLICATIONS

Zierhofer, et al. "Electronic Design Of A Cochlear Implant For Multichannel High-Rate Pulsatile Stimulation Strategies", IEEE, Inc. New York US vol. 3 (Mar. 1, 1995) pp. 112-116.
Fischler, et al. "Dynamic Response Of Middle-Ear Structures", Journal of the Acoustical Society of America, Melville NY US, vol. 41 (May 1967) pp. 1220-1231.
"Fonix FP40/FP40-D Hearing Aid Analyzers" specification sheets, Frye Electronics [1997].

* cited by examiner

*Primary Examiner*—Vivian Chin
*Assistant Examiner*—Con P Tran
(74) *Attorney, Agent, or Firm*—Casimir Jones SC

(57) ABSTRACT

The present invention relates to the field of devices and methods for improving testing of hearing devices, including soundbridges and direct drive middle ear implants. In particular, the present invention provides a microphone system utilizing reverse transfer function to assess the operability of implanted hearing improvement devices, including but not limited to soundbridges and direct drive middle ear implants.

16 Claims, 1 Drawing Sheet

SOUNDBRIDGE TEST SYSTEM

The present Application is a Continuation of U.S. application Ser. No. 10/181,647 filed Dec. 2, 2002, now abandoned, which is a U.S. National Entry of PCT Application PCT/US2001/001957 filed Jan. 19, 2001, which claims priority to U.S. Provisional Application Ser. No. 60/177,406, filed Jan. 20, 2000.

FIELD OF THE INVENTION

The present invention relates to the field of devices and methods for improving testing of hearing devices, including soundbridges and direct drive middle ear implants.

BACKGROUND OF THE INVENTION

The auditory system is generally comprised of an external ear, a middle ear and an internal ear. The external ear includes the auricle (i.e., the ear flap) and auditory canal, while the internal ear includes the oval window and the vestibule which is a passageway to the cochlea. The middle ear is positioned between the external ear and the middle ear, and includes the eustachian tube, the tympanic membrane or eardrum, and three bones called ossicles, and the middle ear space. The three ossicles (i.e., the malleus, incus, and stapes), are positioned between and connected to the tympanic membrane and the oval window.

In a person with normal hearing, sound enters the external ear, where it is slightly amplified by the resonant characteristics of the auditory canal of the external ear. The sound waves produce vibrations in the tympanic membrane. The force of these vibrations is magnified by the ossicles.

Upon vibration of the ossicles, the oval window conducts the vibrations to cochlear fluid in the inner ear, thereby stimulating receptor cells or hairs within the cochlea. In response to the stimulation, the hairs generate an electrochemical signal that is delivered to the brain via one of the cranial nerves, allowing the brain to perceive sound.

A number of auditory system defects impair or prevent hearing. Some patients have ossicles that lack the resiliency necessary to increase the force of vibrations to a level that will adequately stimulate the receptor cells in the cochlea. Other patients have ossicles that are broken, and which therefore do not conduct sound vibrations to the oval window. However, in most cases, sensorineural hearing loss is due to the lack of proper hair cell function within the cochlea.

Prostheses for ossicular reconstruction are sometimes implanted in patients who have partially or completely broken ossicles. These prostheses are normally cut to fit snugly between the tympanic membrane and the oval window or stapes. The close fit holds the implants in place, although gelfoam is sometimes packed into the middle ear to ensure against loosening. Two basic forms are available: total ossicle replacement prostheses (TORPs) which are connected between the tympanic membrane and the oval window; and partial ossicle replacement prostheses (PORPs) which are positioned between the tympanic membrane and the stapes or between the incus and stapes or between the incus and oval window.

Although these prostheses provide a mechanism by which vibrations may be conducted through the middle ear to the oval window of the inner ear, additional devices are frequently necessary to ensure that vibrations are delivered to the inner ear with sufficient force to produce high quality sound perception. Even when a prosthesis is not used, disease and the like can result in hearing impairment.

Various types of hearing aids have been developed to restore or improve hearing for the hearing impaired. With conventional hearing aids, sound is detected by a microphone, amplified using amplification circuitry, and transmitted in the form of acoustical energy by a speaker or transducer into the middle ear by way of the tympanic membrane. Often the acoustical energy delivered by the speaker is detected by the microphone, causing a high-pitched feedback whistle. Moreover, the amplified sound produced by conventional hearing aids normally includes a significant amount of distortion.

Attempts have been made to eliminate the feedback and distortion problems associated with conventional hearing aid systems. These attempts have yielded devices that convert sound waves into electromagnetic fields having the same frequencies as the sound waves. A microphone detects the sound waves, which are both amplified and converted to an electrical current. The current is delivered to a coil winding to generate an electromagnetic field which interacts with the magnetic field of a magnet positioned in the middle ear. The magnet vibrates in response to the interaction of the magnetic fields, causing vibration of the bones of the middle ear or the skull.

Existing electromagnetic transducers present several problems. Many are installed using complex surgical procedures which present the usual risks associated with major surgery and which also require disarticulating (disconnecting) one or more of the bones of the middle ear. Disarticulation deprives the patient of any residual hearing he or she may have had prior to surgery, placing the patient in a worsened position if the implanted device is later found ineffective in improving the patient's hearing. Thus, the sound produced by these devices includes significant distortion because the vibrations conducted to the inner ear do not precisely correspond to the sound waves detected by the microphone.

In addition to the problems described above with most hearing aids presently in use, methods to assess the functioning of such devices when worn by users are lacking. For example, some methods (e.g., commercially available test systems) used to measure hearing aid performance require very expensive equipment, are expensive to implement, and difficult to use. In addition, these systems can provide misleading results when improperly used. What is needed in the art is an easy to use device for assessment of hearing devices, suitable for use prior to, during and after installation of such devices. In this manner, the proper functioning of the hearing device can be readily assessed and alternative treatment methods considered, should the need arise.

SUMMARY OF THE INVENTION

The present invention relates to the field of devices and methods for improving testing of hearing devices, including soundbridges.

In one embodiment, the present invention provides methods for monitoring the output of an ear implant in a patient, comprising the steps of providing an input signal to an associated implant and a microphone that measures the output from the patient's hearing implant while being supplied with the signal. In some embodiments, the ear implant is a middle ear implant. In alternative embodiments, the microphone is selected from the group consisting of probe, electret, and piezo-electric microphones. In some preferred embodiments, the microphone is placed in the external ear canal of the patient. In particularly preferred embodiments, the microphone monitors vibrations produced by the middle ear of the patient in response to the input signal. In still other preferred embodiments, the method further comprises the step of sealing the microphone from the ambient environment.

In some preferred embodiments of the methods, the input signal is provided by an electromagnetic induction coil. In still other embodiments, the level of the input signal varies. In particularly preferred embodiments, the input signal comprises pure tone frequencies in the range of approximately 0.1 kHz to 10 kHz; in even more preferred embodiments, the input signal is in the range between 1 and 2 kHz. In further embodiments, the input signal comprises an input signal comprising a composite signal of two or more multiple pure tones, wherein the pure tones are in the range of 0.1 kHz and 10 kHz. In some preferred embodiments, the composite (i.e., complex) signals are displayed as a function of decibel level for the relevant audio frequencies from approximately 0.25 to 8 kHz. In still other embodiments, the input signal comprises sound selected from the group consisting of speech, music, chirps, or pink noise.

In alternative preferred embodiments of the methods, a separate channel is used to accommodate intraoperative monitoring of the microphone. In particularly preferred embodiments of the methods, a computer-based system is used. In some embodiments involving calculations, a series of mathematical factors are utilized to calculate a predictive output level in decibels, for the middle ear implant under assessment. In other embodiments, the probe microphone level is expressed as a function of this decibel level.

The present invention also provides devices and methods for monitoring the output of an associated ear implant (e.g., a direct drive middle ear implant). In some methods, the system comprises an input means for providing a signal to an associated implant and a microphone capable of measuring the output from the implant while it is being supplied with signal. In further embodiments, a feedback means is used for monitoring the function of the implant during the surgical implantation of the implant device. In some embodiments, the feedback means comprises a light bar that provides an indication of the sound pressure measured by the microphone. In other embodiments, the feedback means comprises a level indicator in decibels (dB) as the sound pressure level (SPL). In still other embodiments, the microphone is a probe microphone, while in other embodiments it is an electret microphone, and still further embodiments, it is a piezo-electric microphone. In particularly preferred embodiments, the microphone is placed in the external ear canal of a patient. In some embodiments, the system is used to monitor the implantation of a hearing implant, while in other embodiments, the system is used to determine whether the positioned (i.e., surgically placed) implant is functioning properly. In other embodiments, the microphone is used to monitor the vibrations produced by the middle ear in response to the input signal. In particularly preferred embodiments, the microphone is sealed from the ambient environment.

In some preferred embodiments of the methods, the input signal is provided by an electromagnetic induction coil. In these embodiments, the induction coil provides the implant with signal. In still other embodiments, the level of the input signal varies. In particularly preferred embodiments, the input signal comprises pure tone frequencies in the range of approximately 0.1 kHz to 10 kHz; in even more preferred embodiments, the input signal is in the range between 1 and 2 kHz. In further embodiments, the input signal comprises an input signal comprising a composite signal of two or more multiple pure tones, wherein the pure tones are in the range of 0.1 kHz and 10 kHz. In some preferred embodiments, the composite (i.e., complex) signals are displayed as a function of decibel level for the relevant audio frequencies from approximately 0.25 to 8 kHz. In still other embodiments, the input signal comprises sound selected from the group consisting of speech, music, chirps, or pink noise.

In alternative preferred embodiments of the methods, a separate channel is used to accommodate intraoperative monitoring of the microphone. In particularly preferred embodiments of the methods, a computer-based system is used. In some embodiments involving calculations, a series of mathematical factors are utilized to calculate a predictive output level in decibels, for the middle ear implant under assessment. In other embodiments, the probe microphone level is expressed as a function of this decibel level.

The present invention also provides systems for monitoring the output of an associated implant, consisting of an implant means for providing a signal to the implant and a transducer (e.g., microphone) for measuring the output from the implant while being supplied with signal. In particularly preferred embodiments, the implant is a middle ear implant. In some embodiments, the feedback means comprises a light bar that provides an indication of the sound pressure measured by the microphone. In other embodiments, the feedback means comprises a level indicator in decibels (dB) as the sound pressure level (SPL). In still other embodiments, the microphone is a probe microphone, while in other embodiments it is an electret microphone, and still further embodiments, it is a piezo-electric microphone. In particularly preferred embodiments, the microphone is placed in the external ear canal of a patient. In some embodiments, the system is used to monitor the implantation of a hearing implant, while in other embodiments, the system is used to determine whether the positioned (i.e., surgically placed) implant is functioning properly. In other embodiments, the microphone is used to monitor the vibrations produced by the middle ear in response to the input signal. In particularly preferred embodiments, the microphone is sealed from the ambient environment.

In some preferred embodiments of the methods, the input signal is provided by an electromagnetic induction coil. In still other embodiments, the level of the input signal varies. In particularly preferred embodiments, the input signal comprises pure tone frequencies in the range of approximately 0.1 kHz to 10 kHz; in even more preferred embodiments, the input signal is in the range between 1 and 2 kHz. In further embodiments, the input signal comprises an input signal comprising a composite signal of two or more multiple pure tones, wherein the pure tones are in the range of 0.1 kHz and 10 kHz. In some preferred embodiments, the complex signals are displayed as a function of decibel level for the relevant audio frequencies from approximately 0.25 to 8 kHz. In still other embodiments, the input signal comprises sound selected from the group consisting of speech, music, chirps, or pink noise.

In alternative preferred embodiments of the methods, a separate channel is used to accommodate intraoperative monitoring of the microphone. In particularly preferred embodiments of the methods, a computer-based system is used. In some embodiments involving calculations, a series of mathematical factors are utilized to calculate a predictive output level in decibels, for the middle ear implant under assessment. In other embodiments, the probe microphone level is expressed as a function of this decibel level.

DESCRIPTION OF THE INVENTION

Figure 1:
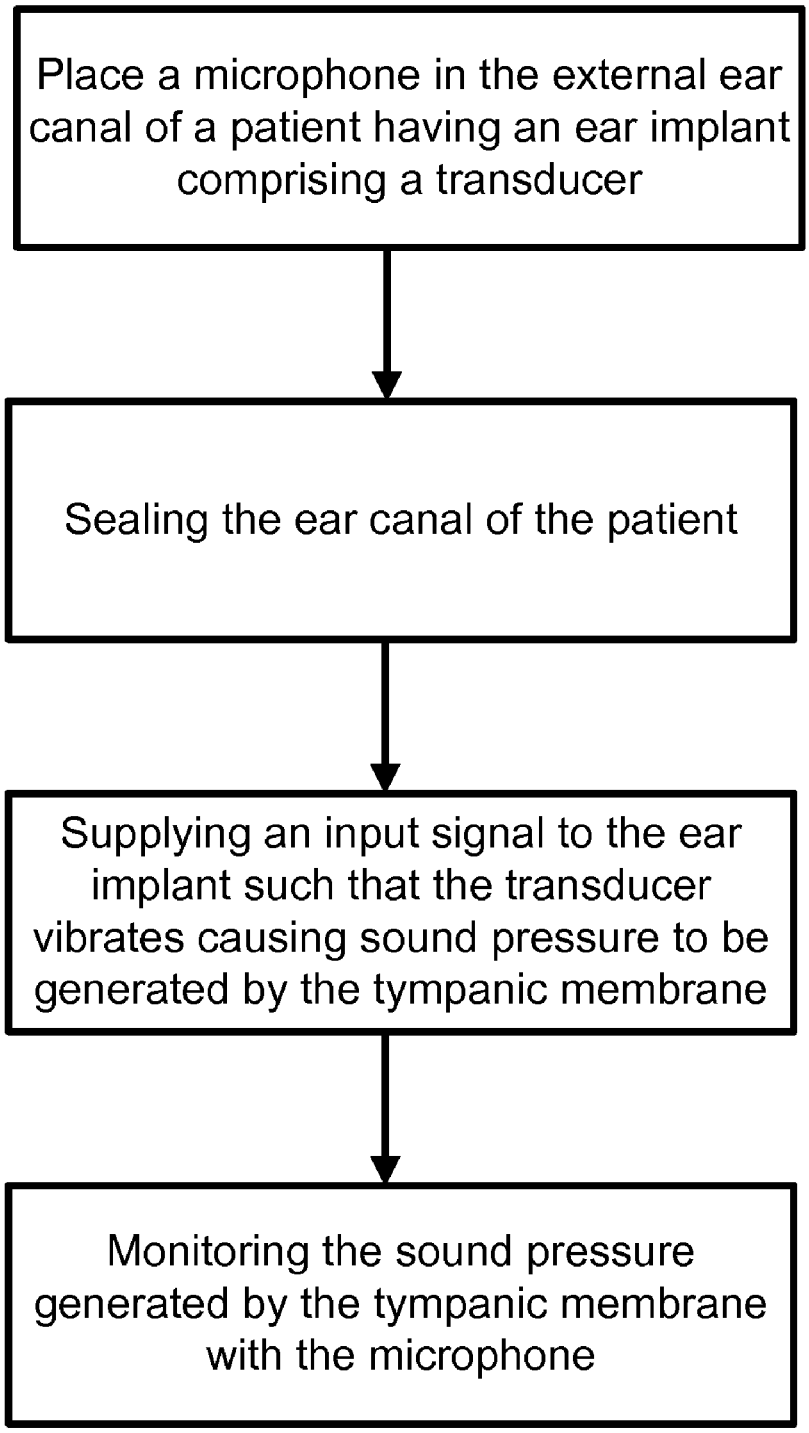
FIG. 1 shows an exemplary flow chart depicting one embodiment of a method for monitoring an ear implant.

The present invention relates to the field of devices and methods for improving testing of hearing devices, including soundbridges and direct drive middle ear implants. The present invention provides various advantages for assessment of hearing device function and efficiency. For example, the present invention allows for assessment of hearing devices prior to and during surgical procedures, as well as for surgical follow-up and long-term hearing device monitoring and maintenance programs.

During the development of hearing devices (e.g., Vibrant® Soundbridge, Symphonix Devices, Inc., San Jose, Calif.), it was observed that sound was emitted from implanted soundbridges into the ear canal of subjects. Although a very low sound level is typically generated, it was determined that the sound can be increased to a point where it can be accurately measured with a probe microphone. It was found that by occluding the ear canal, an increase in sound level can be obtained and is sufficient to be measured.

It was determined that the source of the sound is reverse transfer function (RTF). When the floating mass transducer (FMT™) implanted in a patient's ear is driving the ossicular chain, this also drives the tympanic membrane, producing sound in the ear canal. This sound may be measured and used to assess the functionality of the implanted FMT™. The present invention provides a test system to evaluate the performance of soundbridge implants in patients. For example, it is intended that the present invention will find use in the surgical, as well as post-operative settings. The methods find use during surgical procedures involving a soundbridge, as the surgeon (or other member of the surgical team) can use the present invention to determine whether the FMT™ and vibrating ossicular prosthesis (VORP™) have been properly installed during the procedure. More importantly, the methods can be used to measure implant function after surgery.

Although other methods may allow measurement of middle ear vibrations produced when a middle ear implant is activated (e.g., through use of a laser Doppler vibrometer), such systems are typically very expensive and difficult to use. Furthermore, if used improperly, these systems can provide misleading results. However, it is intended that the present invention encompass the beneficial aspects of these methods, when used in conjunction with other aspects of the present invention.

In preferred embodiments, a coil is used to stimulate the patient's implant and an input transducer (e.g., a microphone) is utilized to measure the output in the ear canal. Various signals can be used to stimulate the VORP™, including but not limited to pure tones, composite signals, and speech. Thus, the present invention provides novel methods in which reverse transfer function is used to measure implant performance. It is further contemplated that the present invention will find the most usefulness in cases where the patient has an implanted soundbridge that produces reverse transfer function sound (e.g., the Vibrant® Soundbridge produced by Symphonix). However, it is not intended that the present invention be limited to any particular implantable hearing devices. For example, it is intended that the present invention will find use in assessing other partially and/or totally implantable devices, including, but not limited to those produced by Hough, Maniglia, Fredrickson, Spindel, and others. It is also possible to program totally implantable systems to emit a tone or other audible signal during surgery or post-operatively with a programmer or from the implant itself (i.e., the implant can be programmed to emit a signal useful in the testing system).

Although in many embodiments, microphones are used as input transducers, it is not intended that the present invention be limited to any particular transducer. For example, any suitable mechanical transducer may be used in the present invention, including but not limited to electromagnetic and piezo-electric transducers. A piezo-electric element when placed in contact with a middle ear structure while a middle ear implant is activated produces a corresponding voltage that can be used to measure the function of an implant. An electromagnetic transducer can also be utilized in the same manner.

In addition, in the various embodiments of the present invention, an important aspect of any microphone used is that it is sealed within the ear canal. Sealing can be achieved using any suitable material(s), including but not limited to foam plugs, rubber plugs, or moldable ("impression") plugs. Sealing the microphone isolates the microphone from the ambient sound environment and increases the level of the emitted sound signal when the implant is activated.

In some embodiments, the present invention provides a system that produces a full set of complex signals and delivers a display as a function of decibel level for the relevant audio frequencies (e.g., from 250 to 8 kHz). In preferred embodiments, this system encompasses output signals of pure tone sweep, composite, white noise, chirp or another complex signal to power the implant, as well as an input transducer that measures sound or mechanical vibrations of the ear or transducer), and a display to show the output measured as a function of frequency from 0.25 to 8 kHz. In particularly preferred embodiments, the signal used is a speech-weighted composite comprised of multiple 80 pure tones cycled at a 10-millisecond rate. This type of signal provides an advantage in that it is possible to quickly make measurements with this system. In still other embodiments, the pure tone sweep of 80 separate cycles at a sweep rate of approximately 30 seconds is used. It is contemplated that using a pure tone sweep in combination with multi-averaging may provide advantages for making reverse transfer measures at higher frequencies (i.e., 2-8 kHz). In other embodiments, measurements of single pure tones (e.g., 1 kHz, 1.5 kHz, and 2 kHz) are used, as in some cases, this is the most straightforward technique for making reverse transfer measurements. However, in still other embodiments, simple pure tones or a combinations of tones and the use of a notch filter or narrow pass filter are sufficient for measurements of reverse transfer.

In some embodiments, the system further includes a means for checking to determine whether the implanted probe microphone has been clogged or dislodged during or after surgery.

In other embodiments, a simple system is used to supply an implant with an appropriate signal and then display the measured output (e.g., with a simple, easy to read and analyze light or light bar). In most cases, it is contemplated that the best frequency for this signal would range between 1 and 2 kHz, as this is the resonant frequency of the ear. It is contemplated that this embodiment will find particular use in the surgical setting, as it allows quick and easy assessment of the functional capability of an implant being installed in a patient.

In alternative particularly preferred embodiments, the present invention also includes a means to record the output from an implant during testing. In this manner, a permanent or temporary record of the implant's functioning is provided.

Definitions

As used herein, the term "subject" refers to a human or other animal. It is intended that the term encompass patients, such as vocally-impaired patients, as well as inpatients or outpatients with which the present invention is used as a diagnostic or monitoring device. It is not intended that the term be limited to any particular type or group of humans or other animals.

As used herein, the terms "external ear canal" and "external auditory meatus" refer to the opening in the skull through which sound reaches the middle ear. The external ear canal extends to the tympanic membrane (or "eardrum"), although the tympanic membrane itself is considered to be part of the middle ear. The external ear canal is lined with skin and due to its resonant characteristics, provides some amplification of sound traveling through the canal. The "outer ear" includes those parts of the ear that are normally visible (e.g., the auricle or pinna, and the surface portions of the external ear canal).

As used herein, the term "middle ear" refers to the portion of the auditory system that is internal to the tympanic membrane, and including the tympanic membrane, itself. It includes the auditory ossicles (i.e., three small bones [malleus, incus, and stapes] that from a bony chain across the middle ear chamber to conduct and amplify sound waves from the tympanic membrane to the oval window). The ossicies are secured to the walls of the chamber by ligaments. The middle ear is open to the outside environment by means of the eustachian tube.

As used herein, the term "inner ear" refers to the fluid-filled portion of the ear. Waves relayed by the ossicles to the oval window are created in the fluid, pass through the cochlea, and stimulate the delicate hair-like endings of the receptor cells of the auditory nerve. These receptors generate electrochemical signals are interpreted by the brain as sound.

As used herein, the term "soundbridge" refers to medical prostheses that serve to improve the hearing of individuals. Although it is not intended that the present invention be so limited, in particularly preferred embodiments, soundbridges are used to improve the hearing of individuals with sensorineural, conductive (i.e., the ossicular connection is broken, loose, stuck, or missing), or mixed sensorineural and conductive hearing loss. Unlike hearing aids that take a sound and make it louder as it enters the middle ear, in particularly preferred embodiments, soundbridges convert acoustic sound to vibrations inside the middle ear. These vibrations are amplified by device electronics in order to make the vibrations stronger than the patient would normally achieve with sound transmitted through the ear canal and across the eardrum. Since in the most preferred embodiments no portion of the soundbridge is present in the ear canal, problems commonly experienced with hearing aids (e.g., occlusion, discomfort, irritation, soreness, feedback, external ear infections, etc.), are eliminated or reduced.

In highly preferred embodiments, the soundbridge is divided into two components, with the external portion comprising an audio processor (e.g., comprised of a microphone, battery, and the electronics needed to convert sound to a signal that can be transmitted to the internal portion of the soundbridge) and the internal portion comprising an internal receiving link and a floating mass transducer (FMT™). The audio processor is positioned on the wearer's head with a magnet. A signal from the audio processor is transmitted across the skin to an internal receiver, which then relays the signal via a conductor link to the FMT™. In turn, the FMT™ converts the signal to vibrations that move the bones of the middle ear in a manner similar to the way in which sounds move them. Thus, ambient sounds (e.g., voices, etc.) are picked up by the microphone in the audio processor and converted to an electrical signal within the audio processor. This electrical signal is then transmitted across the skin to the internal receiver which then conveys the signal to the FMT™ via a conducting link, resulting in mechanical vibration of the ossicles, which are then interpreted by the wearer.

In other preferred embodiments, the present invention provides a completely implantable system in which the microphone, battery, and electronics are positioned under the patient's skin. In such embodiments, the battery is positioned and designed so as to allow recharging while the battery is implanted (i.e., the battery is recharged while it is in position in situ).

As used herein, the term "biocompatible" refers to any substance or compound that has minimal (i.e., no significant difference is seen compared to a control), if any, effect on the surrounding tissue. For example, in some embodiments of the present invention, the enclosure comprises a biocompatible housing containing a microphone; the housing itself has a minimal effect on the tissues surrounding the housing and on the subject after the implantable microphone is surgically placed. It is also intended that the term be applied in references to the substances or compounds utilized in order to minimize or avoid an immunologic reaction to the housing or other aspects of the invention. Particularly preferred biocompatible materials include, but are not limited to titanium, gold, platinum, sapphire, and ceramics.

As used herein, the term "implantable" refers to any device that may be surgically implanted in a patient. It is intended that the term encompass various types of implants. For example, the device may be implanted within a body cavity (e.g., thoracic or abdominal cavities), under the skin (i.e., subcutaneous), or placed at any other location suited for the use of the device. An implanted device is one that has been implanted within a subject, while a device that is "external" to the subject is not implanted within the subject (i.e., the device is located externally to the subject's skin).

As used herein, the term "hermetically sealed" refers to a device or object that is sealed in a manner that liquids or gas located outside the device is prevented from entering the interior of the device, to at least some degree. It is intended that the sealing be accomplished by a variety of means, including but not limited to mechanical, glue or sealants, etc. In particularly preferred embodiments, the hermetically sealed device is made so that it is completely leak-proof (i.e., no liquid or gas is allowed to enter the interior of the device at all).

As used herein, the term "reproduction of sound" refers to the reproduction of sound information from an audiofrequency source of electrical signals. It is intended that the term encompass complete sound reproduction systems (i.e., comprising the original source of audio information, preamplifier, and control circuits, audiofrequency power amplifier[s] and loudspeaker[s]). It is intended that the term encompass monophonic, as well as stereophonic sound reproduction, including stereophonic broadcast transmission. In some embodiments, a sound reproduction system composed of high-quality components, and which reproduces the original audio information faithfully and with very low noise levels, is referred to as a "high-fidelity" system (hi-fi). As used herein, the term "audio processor" refers to any device or component that processes sound for any purpose.

As used herein, the term "acoustic wave" and "sound wave" refer to a wave that is transmitted through a solid, liquid, and/or gaseous material as a result of the mechanical vibrations of the particles forming the material. The normal mode of wave propagation is longitudinal (i.e., the direction of motion of the particles is parallel to the direction of wave propagation), the wave therefore consists of compressions and rarefactions of the material. It is intended that the present invention encompass waves with various frequencies, although waves falling within the audible range of the human ear (e.g., approximately 20 Hz to 20 kHz). Waves with frequencies greater than approximately 20 kHz are "ultrasonic" waves.

As used herein, the term "frequency" (ν or f) refers to the number of complete cycles of a periodic quantity occurring in a unit of time. The unit of frequency is the "hertz," corresponding to the frequency of a periodic phenomenon that has a period of one second. Table 1 below lists various ranges of frequencies that form part of a larger continuous series of frequencies. Internationally agreed radiofrequency bands are shown in this table. Microwave frequencies ranging from VHF to EHF bands (i.e., 0.225 to 100 GHz) are usually subdivided into bands designated by the letters, P, L, S, X, K, Q, V, and W.

TABLE 1

Radiofrequency Bands

| Frequency | Band | Wavelength |
|---|---|---|
| 300 to 30 GHz | Extremely High Frequency (EHF) | 1 mm to 1 cm |
| 30 to 3 GHz | Superhigh Frequency (SHF) | 1 cm to 10 cm |
| 3 to 0.3 GHz | Ultrahigh Frequency (UHF) | 10 cm to 1 m |
| 300 to 30 MHz | Very High Frequency (VHF) | 1 m to 10 m |
| 30 to 3 MHz | High Frequency (HF) | 10 m to 100 m |
| 3 to 0.3 MHz | Medium Frequency (MF) | 100 m to 1000 m |
| 300 to 30 kHz | Low Frequency (LF) | 1 km to 10 km |
| 30 to 3 kHz | Very Low Frequency (VLF) | 10 km to 100 km |

As used herein, the term "gain," measured in decibels, is used as a measure of the ability of an electronic circuit, device, or apparatus to increase the magnitude of a given electrical input parameter. In a power amplifier, the gain is the ratio of the power output to the power input of the amplifier. "Gain control" (or "volume control") is a circuit or device that varies the amplitude of the output signal from an amplifier.

As used herein, the term "decibel" (dB) is a dimensionless unit used to express the ratio of two powers, voltages, currents, or sound intensities. It is 10× the common logarithm of the power ratio. If two power values (P1 and P2) differ by n decibels, then $n=10 \log_{10}(P2/P1)$, or $P2/P1=10^{n/10}$. If P1 and P2 are the input and output powers, respectively, of an electric network, if n is positive (i.e., P2>P1), there is a gain in power. If n is negative (i.e., P1>P2), there is a power loss.

As used herein, the terms "carrier wave" and "carrier" refer to a wave that is intended to be modulated in modulated, or, in a modulated wave, the carrier-frequency spectral component. The process of modulation produces spectral components termed "sidebands" that fall into frequency bands at either the upper ("upper sideband") or lower ("lower sideband") side of the carrier frequency. A sideband in which some of the spectral components are greatly attenuated is referred to a "vestigial sideband." Generally, these components correspond to the highest frequency in the modulating signals. A single frequency in a sideband is referred to as a "side frequency," while the "baseband" is the frequency band occupied by all of the transmitted modulating signals.

As used herein, the term "modulation" is used in general reference to the alteration or modification of any electronic parameter by another. For example, it encompasses the process by which certain characteristics of one wave (the "carrier wave" or "carrier signal") are modulated or modified in accordance with the characteristic of another wave (the "modulating wave"). The reverse process is "demodulation," in which an output wave is obtained that has the characteristics of the original modulating wave or signal. Characteristics of the carrier that may be modulated include the amplitude, and phase angle. Modulation by an undesirable signal is referred to as "cross modulation," while "multiple modulation" is a succession of processes of modulation in which the whole, or part of the modulated wave from one process becomes the modulating wave for the next.

As used herein, the term "demodulator" ("detector") refers to a circuit, apparatus, or circuit element that demodulates the received signal (i.e., extracts the signal from a carrier, with minimum distortion). "A modulator" is any device that effects modulation.

As used herein, the term "dielectric" refers to a solid, liquid, or gaseous material that can sustain an electric field and act as an insulator (i.e., a material that is used to prevent the loss of electric charge or current from a conductor, insulators have a very high resistance to electric current, so that the current flow through the material is usually negligible).

As used herein, the term "electronic device" refers to a device or object that utilizes the properties of electrons or ions moving in a vacuum, gas, or semiconductor. "Electronic circuitry" refers to the path of electron or ion movement, as well as the direction provided by the device or object to the electrons or ions. A "circuit" or "electronics package" is a combination of a number of electrical devices and conductors that when connected together, form a conducting path to fulfill a desired function, such as amplification, filtering, or oscillation. Any constituent part of the circuit other than the interconnections is referred to as a "circuit element." A circuit may be comprised of discrete components, or it may be an "integrated circuit." A circuit is said to be "closed," when it forms a continuous path for current. It is contemplated that any number of devices be included within an electronics package. It is further intended that various components be included in multiple electronics packages that work cooperatively to amplify sound. In some embodiments, the "vocal electronics" package refers to the entire system used to improve and/or amplify sound production.

As used herein, the term "electret" refers to a substance that is permanently electrified, and has oppositely charged extremities.

As used herein, the term "amplifier" refers to a device that produces an electrical output that is a function of the corresponding electrical input parameter, and increases the magnitude of the input by means of energy drawn from an external source (i.e., it introduces gain). "Amplification" refers to the reproduction of an electrical signal by an electronic device, usually at an increased intensity. "Amplification means" refers to the use of an amplifier to amplify a signal. It is intended that the amplification means also includes means to process and/or filter the signal.

As used herein, the term "receiver" refers to the part of a system that converts transmitted waves into a desired form of output. The range of frequencies over which a receiver operates with a selected performance (i.e., a known level of sensitivity) is the "bandwidth" of the receiver. The "minimal discernible signal" is the smallest value of input power that results in output by the receiver.

As used herein, the term "transmitter" refers to a device, circuit, or apparatus of a system that is used to transmit an electrical signal to the receiving part of the system. A "transmitter coil" is a device that receives an electrical signal and broadcasts it to a "receiver coil." It is intended that transmitter and receiver coils may be used in conjunction with centering magnets which function to maintain the placement of the coils in a particular position and/or location.

As used herein, the terms "speaker" and "loudspeaker" refer to electroacoustic devices that convert electrical energy into sound energy. The speaker is the final unit in any sound reproducer or acoustic circuit of any broadcast receiver. It is not intended that the present invention be limited to any particular type of speaker. For example, the term encompasses loudspeakers including but not limited to magnetic, cone, horn, crystal, magnetorestriction, magnetic-armature, electrostatic, labyrinth speakers. It is also intended that multiple speakers of the same or different configurations will be used in the present invention.

As used herein, the term "microphone" refers to a device that converts sound energy into electrical energy. It is the converse of the loudspeaker, although in some devices, the speaker-microphone may be used for both purposes (i.e., a loudspeaker microphone). Various types of microphones are encompassed by this definition, including carbon, capacitor, crystal, moving-coil, and ribbon embodiments. Most microphones operate by converting sound waves into mechanical vibrations that then produce electrical energy. The force exerted by the sound is usually proportional to the sound pressure. In some embodiments, a thin diaphragm is mechanically coupled to a suitable device (e.g., a coil). In alternative embodiments the sound pressure is converted to electrical pressure by direct deformation of suitable magnetorestrictive or piezoelectric crystals (e.g., magnetorestriction and crystal microphones).

As used herein, the term "transducer" refers to any device that converts a non-electrical parameter (e.g., sound, pressure or light), into electrical signals or vice versa. Microphones are one electroacoustic transducers.

As used herein, the term "resistor" refers to an electronic device that possess resistance and is selected for this use. It is intended that the term encompass all types of resistors, including but not limited to, fixed-value or adjustable, carbon, wire-wound, and film resistors. The term "resistance" (R; ohm) refers to the tendency of a material to resist the passage of an electric current, and to convert electrical energy into heat energy.

As used herein, the term "reset" refers to the restoration of an electrical or electronic device or apparatus to its original state following operation of the equipment.

As used herein, the term "residual charge" refers to the portion of a charge stored in a capacitor that is retained when the capacitor is rapidly discharged, and may be subsequently withdrawn. Although it is not necessary to use the present invention, it is hypothesized that this results from viscous movement of the dielectric under charge causing some of the charge to penetrate the dielectric and therefore, become relatively remote from the plates; only the charge near the plates is removed by rapid discharge.

As used herein, the term "current" refers to the rate of flow of electricity. The current is usually expressed in amperes; the symbol used is "I."

As used herein, the term "residual current" refers to a current that flows for a short time in the external circuit of an active electronic device after the power supply to the device has been turned off. The residual current results from the finite velocity of the charge carriers passing through the device. The term "active" is used in reference to any device, component or circuit that introduces gain or has a directional function. An "active current," "active component," energy component," "power component" or "in-phase component of the current" refers to the component that is in phase with the voltage, alternative current, and voltage being regarded as vector quantities. The term "passive" refers to any device, component or circuit that does not introduce gain, or does not have a directional function. It is intended that the term encompass pure resistance, capacitance, inductance, or a combination of these.

As used herein, the terms "power source" and "power supply" refer to any source of electrical power in a form that is suitable for operating electronic circuits. Alternating current power may be derived either directly or by means of a suitable transformer. "Alternating current" refers to an electric current whose direction in the circuit is periodically reversed with a frequency $f$, that is independent of the circuit constants. Direct current power may be supplied from various sources, including, but not limited to batteries, suitable rectifier/filter circuits, or from a converter. "Direct current" refers to an unidirectional current of substantially constant value. The term also encompasses embodiments that include a "bus" to supply power to several circuits or to several different points in one circuit. A "power pack" is used in reference to a device that converts power from an alternating current or direct current supply, into a form that is suitable for operating electronic device(s).

Experimental

The following examples are provided in order to demonstrate and further illustrate certain preferred embodiments and aspects of the present invention and are not to be construed as limiting the scope thereof.

In the experimental disclosure which follows, the following abbreviations apply: dB (decibel); kHz (kilohertz); SPL (sound pressure level); reverse transfer function (RTF); floating mass transducer (FMT™); vibrating ossicular prosthesis (VORP™); Frye Electronics (Frye Electronics, Inc., Tigard, Oreg.); Realistic (Realistic, Radio Shack, Ft. Worth, Tex.); Symphonix (Symphonix Devices, San Jose, Calif.); and Knowles (Knowles Electronics, Itasca, Ill.).

EXAMPLE 1

Microphone Probe Development

In these experiments, probe microphones were assessed for their ability to transmit sounds in various embodiments of the present invention. It was determined that although several commercial probe microphone measurement systems are available (e.g., from Frye Electronics and AudioScan), modifications of the output stages of these systems were necessary in order to achieve accurate signal delivery. For example, the output stage of a Frye Electronics FP-40 microphone was successfully modified, such that it was possible to record the output generated by an FMT™ with a probe microphone. In addition to the commercially available probe microphones, Mueller et al., provide a review and analysis of various probe microphone measurements for hearing aid selection and assessment (See, Mueller et al., Probe Microphone Measurements: Hearing Aid Selection and Assessment, Singular Publishing Group, Inc., San Diego [1992], herein incorporated be reference).

In these experiments, previously frozen temporal bones were used to observe whether the position of the transducer influenced the reverse transfer value. Various transducer positions were tested, including those that were tightly crimped (or tightly formed) on the incus, as well as those that were more loosely attached. "Crimped transducers" are tightly wound and the securely formed onto the incus, allowing good contact with the lenticular process. With "non-crimped" or "loose" transducers, the legs are pulled slightly apart until noticeable give develops through the attachment.

As these experiments involved the use of the FP-40 probe microphone, experiments were first conducted to ensure that this microphone was capable of measuring sound pressure generated by the middle ear when the ear was driven with an FMT. The results indicated that this probe microphone was indeed capable of measuring sound pressure under these conditions.

Differences between "crimped" transducers and "non-crimped" transducers placed in the standard inferior position of the temporal bone were determined. In some cases, it was observed that there was no objective difference in the reverse transfer values for well-positioned transducers as compared to transducers with subjectively less ideal positions. Furthermore, when the transducer is not in contact with a vibratory structure of an ear, no reverse transfer value was obtainable. However, when a transducer is positioned in such a way that it is in contact with the tympanic membrane, but not in contact with the incus, as it should be, a significant reverse transfer value can be produced (i.e., a false positive). Such false positives can be detected using laser doppler methods. As clogged microphones produce an erratic, narrow frequency or an otherwise obscure and atypical result, depending upon how they are occluded. In order to avoid false positive, attention must be paid to the placement, attachment, and position of the device.

In the temporal bone experiments completed thus far, the reverse transfer measurements have demonstrated good linearity as a function of power input for transducers correctly installed into the middle ear. The dB values obtained demonstrated a peak resonance pattern in the 1 to 2 kHz range, which is consistent with resonances of normal middle ears. The dB value measured with the probe microphone is a function of the TM displacement and the reverse transfer ability of the middle ear.

Properly installed FMTs can sometimes produce a higher signal than transducers that are less optimally installed and/or have a poor position. Unfortunately, transducers that are in a poor position but are at the same time in contact with the ear drum or other vibratory structure of the ear can also produce significant reverse transfer levels. Indeed, the most important factor was the seal. If a good seal is not achieved, the level of the reverse transfer decreases and the noise floor increases. As used herein, the term "good seal," refers to a seal that completely seals the external ear canal from ambient sound.

EXAMPLE 2

Positioning of the Probe Microphone

In these experiments, the effect of varying the positions of the probe microphone during testing was investigated using temporal bones. In these experiments, a foam ear plug was inserted into the ear canal and a transducer (01599) was positioned at various distances from the plug near the hub of the syringe. The probe microphone was placed at the opposite end of the plug (i.e., near the large, open end of the syringe), at approximately 2 mm, 4 mm, and 6 mm in fresh human temporal bone. The plug was used as in these experiments to seal the test system from ambient room noise. At the conclusion of these experiments, the transducer was removed and replace, and the measurements repeated several times.

The results of these experiments indicated that the depth of the probe microphone was not a critical factor in obtaining reliable measurements from fresh human temporal bone. However, measurements taken at 18 mm when the yellow foam ear plug no longer completely seals the ear canal did show a difference.

From the above, it is clear that the present invention provides devices and methods for testing the functioning of hearing devices, including soundbridges. Various modifications and variations of the described method and system of the invention will be apparent to those skilled in the art without departing from the scope and spirit of the invention.

I claim:

1. A method for monitoring an ear implant, comprising:

a) placing a microphone into the external ear canal of a patient having an ear implant, wherein said ear implant comprises a transducer;

b) sealing said ear canal in order to isolate said microphone from the ambient sound environment;

c) supplying an input signal to said ear implant such that said transducer vibrates the ossicular chain which drives the tympanic membrane causing sound pressure to be generated by the tympanic membrane of said patient; and d) monitoring said sound pressure generated by said tympanic membrane of said middle ear with said microphone.

2. The method of claim 1, wherein said input signal is supplied by an electromagnetic induction coil.

3. The method of claim 1, wherein said input signal comprises pure tone frequencies between approximately 0.1 kHz and 10 kHz.

4. The method of claim 1, wherein said input signal comprises pure tone frequencies between approximately 1 kHz and 2 kHz.

5. The method of claim 1, wherein said input signal varies.

6. The method of claim 1, wherein said input signal comprises an input signal comprising a composite signal of two or more pure tones, wherein said pure tones are in the range of 0.1 kHz to 10 kHz.

7. The method of claim 1, wherein said ear implant further comprises a microphone and battery.

8. The method of claim 7, wherein said microphone and battery are both positioned under said patient's skin.

9. The method of claim 1, wherein said ossicular chain comprises the malleus, incus, and stapes, and wherein said transducer is in contact with said incus.

10. The method of claim 1, wherein said ear implant is a direct drive middle ear implant.

11. A method for monitoring an ear implant, comprising:

a) placing a microphone into the external ear canal of a patient having an ear implant, wherein said ear implant comprises a transducer in contact with an incus bone;

b) sealing said ear canal in order to isolate said microphone from the ambient sound environment;

c) supplying an input signal to said ear implant such that said transducer vibrates said incus bone which drives the tympanic membrane causing sound pressure to be generated by said tympanic membrane of said patient; and d) monitoring said sound pressure generated by said tympanic membrane with said microphone.

12. The method of claim 10, wherein said input signal is supplied by an electromagnetic induction coil.

13. A method for monitoring an ear implant, comprising:

a) providing a patient having:

i) an ear implant comprising a transducer, and ii) a microphone located in the external ear canal of said patient;

b) sealing said ear can in order to isolate said microphone from the ambient sound environment;

c) supplying an input signal to said ear implant such that said transducer vibrates causing the ossicular chain which drives the tympanic membrane causing sound pressure to be generated by the tympanic membrane of said middle ear of said patient; and d) monitoring said sound pressure generated by said tympanic membrane with said microphone.

14. The method of claim 13, wherein said middle ear comprises the malleus, incus, and stapes, and wherein said transducer is in contact with said incus.

15. The method of claim 13, wherein said ear implant further comprises a microphone and battery.

16. The method of claim 15, wherein said microphone and battery are both positioned under said patient's skin.

* * * * *